United States Patent [19]

Gue ou et al.

[11] Patent Number: 4,836,743

[45] Date of Patent: Jun. 6, 1989

[54] CROSS FLOW FAN

[75] Inventors: Jean-Pierre Gue ou, Athis-Mons; Gilles Heid, Toulouse; Pierre Bailleux, Templeuve; Marc Pruvost, Lille, all of France

[73] Assignees: Etat Francais, Paris Armees; Office National d'Etudes et de Recherches Aerospatiales, Chatillon/Bagneux, both of France

[21] Appl. No.: 228,177

[22] Filed: Aug. 4, 1988

[30] Foreign Application Priority Data

Aug. 13, 1987 [FR] France ..... 87 11522

[51] Int. Cl.[4] ..... F04D 29/44

[52] U.S. Cl. ..... 415/53.1; 415/204

[58] Field of Search ..... 415/54, 204, 184, 205

[56] References Cited

U.S. PATENT DOCUMENTS

| | | | |
|---|---|---|---|
| 3,305,665 | 2/1967 | Laing | 415/204 |
| 3,385,511 | 8/1966 | Wentling | 415/204 |
| 3,459,365 | 8/1969 | Glucksman | 415/54 |

FOREIGN PATENT DOCUMENTS

| | | | |
|---|---|---|---|
| 1951115 | 3/1971 | Fed. Rep. of Germany | 415/54 |
| 2545036 | 4/1977 | Fed. Rep. of Germany | 415/54 |
| 757543 | 7/1953 | United Kingdom | 415/54 |
| 830362 | 5/1957 | United Kingdom | 415/54 |

*Primary Examiner*—Robert E. Garrett
*Assistant Examiner*—Michael V. Readey
*Attorney, Agent, or Firm*—Oliff & Berridge

[57] ABSTRACT

The purpose of the invention is a cross flow fan comprising an convergent inlet (2,3,10), an impeller (1) or rotor provided with blades and a divergent (4) delimited by a downstream face (12) of the scroll element and a downstream face (9) of the cross-head element. The inlet and divergent delimit two narrowing longitudinal passages (13, 14). With respect to a reference system of perpendicular axes x and y, the origin of which is located on the axis of rotation of the impeller (1) and whose abscissa X axis is parallel to the downstream face (9) of the cross-head element, it features:

- an upstream leading edge (6) of the cross-head element describing an angle included between 290° and 330° at a distance from the impeller or an air gap (13) included between 2 and 8% of the outside diameter De of the impeller,
- a face (7) of the cross-head element describing an angle, the apex of which is one and the same with upstream leading edge (6) of the cross-head, included between −20° and 60°,
- a rectilinear scroll leading edge (11) describing an angle included between 76 and 112% at a distance from the impeller, or an air gap (14) included between 2 and 8% of outside diameter De of the impeller,
- a plane upstream face (b 10) concurrent with leading edge (11) of the scroll, inclined with respect to the plane connecting the rotation axis of the impeller and the scroll leading edge (11). The invention applies to the sustentation of hovercraft.

17 Claims, 5 Drawing Sheets

FIG. 2
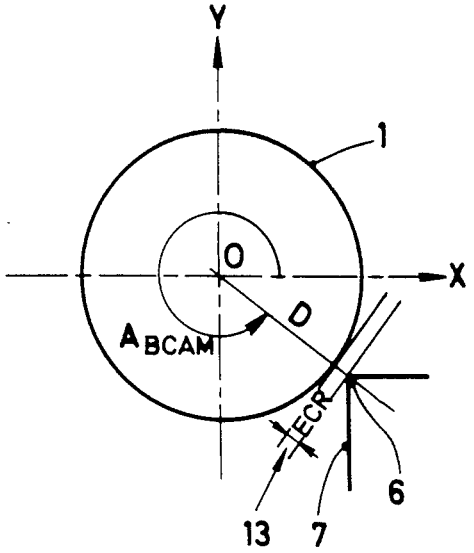
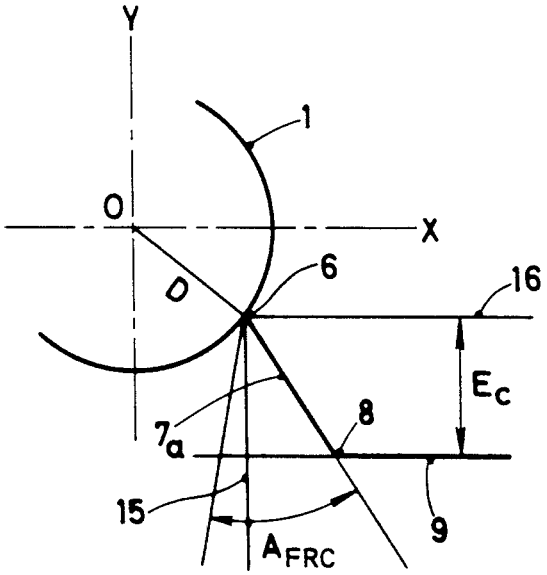
FIG. 3
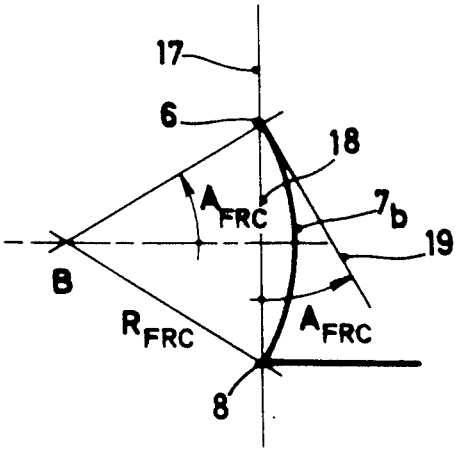
FIG. 4

FIG.5
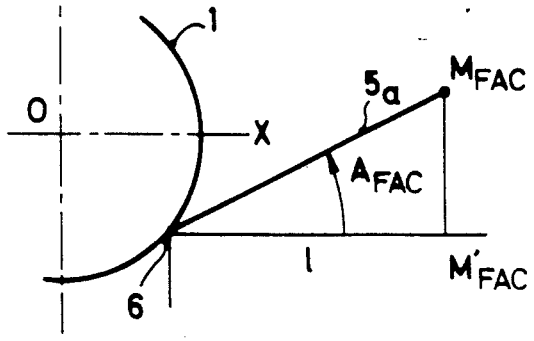
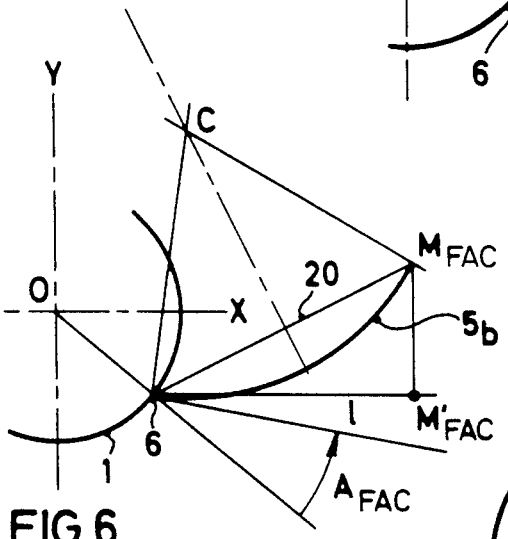
FIG.6
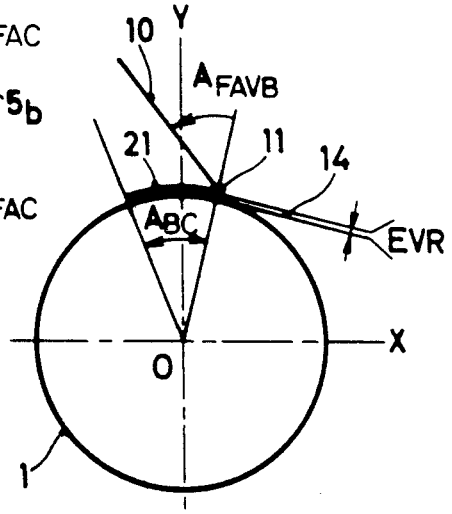
FIG.7
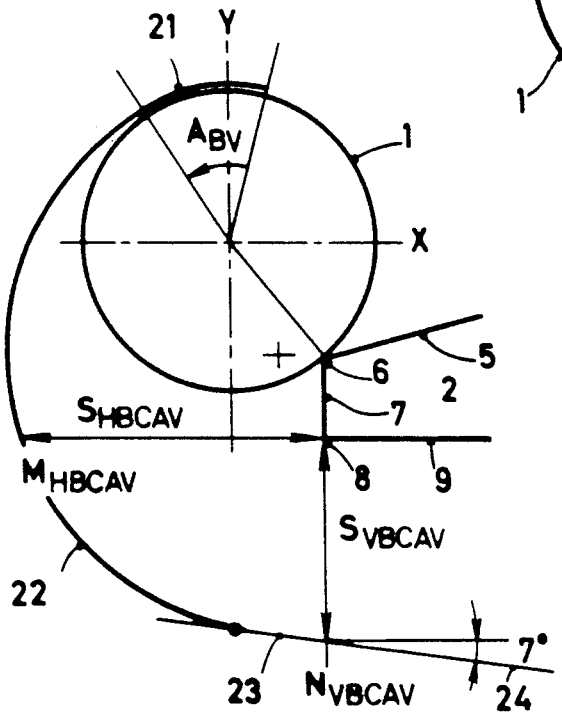
FIG.8

CROSS FLOW FAN

The technical scope of this invention is that of cross flow fans applied to the ventilation of a room or machine or to the support of an air cushioned vehicle, for instance a hovercraft.

BACKGROUND OF THE INVENTION

This type of fan is well known and was first proposed in 1892 by MORTIER for the ventilation of coal mines. The leading feature of the fan is that it has a humped pressure-flow characteristic, the increasing section of which represents between 50 and 75% of the maximum accessible range (or excursion) in terms of flow. The second particular feature is that its zero flow pressure is different from zero. Another characteristic of this fan is the simultaneous supply of high flow and pressure coefficients, compared with a centrifugal fan which, for an equal size, supplies only a high pressure coefficient for low flow coefficient and the axial fan which, conversely and for equal size, only supplies a high flow coefficient at a low pressure coefficient. Consequently, the aeraulic power supplied by the transverse fan is far superior. The weak point of the fan is, traditionally, the efficienty obtained which can be improved by adjusting the stator shapes.

For information, refer to patent DE-A-1 428 071 relative to a cross flow fan with a stable air flow characteristic and which has a low noise feature.

Reference may also be made to patent DE-A-2 545 036 which is an improvement to the fan covered by the previous patent with a complex system of guide walls and porous walls placed on the fluid flow to reduce noise. However, this advantage may be compromised by the clogging of the porous walls after a certain period of use.

There is also a patent FR-A-2 481 378 designed to reduce the noise level and supply an increased air flow for the same rotor speed through a particular rounded shape of the downstream scroll and of the scroll and cross-head leading edge.

However, not that these three documents concern domestic equipment in which the air flow is less than 0.05 $m^3/s$ with pressure less than 50 Pa.

There is also a device for the ventilation of fluid radiators and rheostats of a driving element using a cross flow fan. However, these relate more particularly to the incorporation of the fan into a structure where little space is available.

In these prior constructions, the flow properties of the cross flow fan are used more particularly and no attempt has ever been made to improve the shapes of the convergent inlet and downstream diffuser to simultaneously obtain high flow and pressure while achieving high yield. A first attempt was made in a theoretical study published by G. HEID, Revue Francaise de Mécanique 1986-2, relating to the application of BIDARD's theory relative to compressor surge, to the study of surge phenomena in cross flow fans. Indeed, all the known designs of cross flow fans are set configurations meeting a specific problem of flow; the man of the art cannot extrapolate the results obtained from these designs. This study also made it possible to formulate the following conclusions:

From the pressure standpoint, the rotor behaves as a single stage thus offering the advantage of increasing the flow by increasing its length, Only upstream/downstream asymmetry of stator shapes will determine the direction of flow, For the same pressure/flow couple, it is possible to choose several combinations of diameter/length/speed of rotation combinations for the rotor.

SUMMARY OF THE INVENTION

The purpose of this invention is therefore to define, for the first time, a cross flow fan with characteristics defined in advance in order to obtain, simultaneously in a technical installation, flow and pressure coefficients capable of achieving, respectively, 2.5 to 3 approximately while controlling the stability of the operating point over the entire flow range and more particularly, over the increasing section of the pressure-flow characteristic for which it is known that a surge phenomenon may be generated. It is known that a surge phenomenon like this results in periodic pulsations in flow and pressure in the downstream circuit, characterized by a frequency and a surge amplitude, rendering the machine unusable for industrial applications.

Therefore, the purpose of the invention is a cross flow fan comprising an convergent inlet delimited by a scroll element upstream face and a cross-head element upstream face, an impeller or rotor provided with blades and a divergent delimited by a face downstream of the scroll element and a face downstream of the cross-head element with said inlet and divergent delimiting, with respect to the impeller in a place perpendicular to its axis of rotation, two longitudinal narrowing pasages defined on the one hand, by a scroll element leading edge and on the other hand, by an upstream leading edge of the cross-head element, characterized insofar as a reference system of perpendicular axes, with its origin located at the axis of rotation of the impeller and having an abscissa axis parallel to the downstream face of the cross-head element which features:

A leading edge upstream of the cross-head element describing an angle of between 290° and 330° at a distance from the impeller or air gap included between 2 and 8% of the outside diameter De of the impeller, A face of the cross-head element describing an angle whose apex is one and the same as the upstream leading edge of the cross-head, included between −20° and 60° with respect to an axis running parallel to the axis of the ordinates concurrent with the upstream leading edge, A rectilinear scroll leading edge describing an angle of between 76° and 112° at a distance from the impeller or air gap included between 2 and 8% of the outside diameter De of the impeller, A plane upstream face, concurrent with the scroll leading edge and inclined with respect to the plane connecting the axis of rotation of the impeller and the scroll leading edge by an angle with a value included between 0° and 70°.

The cross-head element, between its upstream and downstream leading edges has a thickness of between 1 and 40% of the outside diameter De of the impeller.

The thickness of the cross-head element is equal to 16% of the outside diameter De of the impeller.

The cross-head-impeller face is fat and inclined with respect to the axis of the ordinates by an angle included between −20° and 60°.

The cross-head-impeller face is hollow and in the form of a circle arc passing through the upstream and downstream leading edges of the cross-head element, both placed on a line parallel to the y axis in such a way that the tangent to the upstream leading edge delimits with said parallel to the ordinates axis, an angle for the ordinates varying between 0° and 60°.

Length (1) of the upstream face of the cross-head, extended onto the abscissa axis is included between 90 and 100% of the outside diameter De of the impeller.

The upstream face of the cross-head comprises a plane surface inclined by an angle included between 10° and 30° with respect to the abscissa axis.

The angle of inclination equals 26° and length (1) at 95% of the outside diameter De of the impeller.

The upstream face of the cross-head comprises a circle arc open toward the impeller with a tangent to the upstream leading edge of the cross-head delimiting with respect to the radius passing through the upstream leading edge, an angle included between 20° and 80°.

The downstream scroll is extended in a divergent delimiting an angle of 7° with respect to the axes of the abscissa from a point located on a parallel to the ordinate axis passing through the downstream cross-head leading edge at a distance from said leading edge of between 60 and 90% of the outside diameter De of the impeller.

The downstream scroll is delimited in section by an initial circle arec concentric with the impeller and a second circle arc connecting the first circle arc to the divergent.

The downstream scroll passes through an axis located on a parallel to the x axis, passing through the cross-head downstream leading edge at a distance from the latter included between 60 and 120% of the external diameter De of the impeller.

This distance equals 59% of the outside diameter De of the impeller.

The impeller is of the forward-curved blade type with an internal diameter included between 70 and 80% of its external diameter and each blade presenting, as a function of the outside diameter De of the impeller, a curve radius between 10 and 15%, a chord included between 10 and 15% and aspect ratio included between 1 and 5.

The blades are twisted longitudinally through a helix angle of less than 10°.

The impeller is twisted by the rotation of the end flanges with respect to one another.

The cross-head leading edge element is twisted through an angle of helix less than 10°.

One result of said invention resides in the obtaining of high efficienty reaching 70 to 80%.

Another result is that the intrinsic characteristics of the cross flow fan are used profitably to obtain a layer-like flux of air or air curtain; in this way, the flow rate is proportional to the length of the impeller, at constant rotation velocity, then the value of aeraulic mentionless coefficient is respected.

Another result is the increased surge margin.

Another result comes from the fact that power levels on the order of one megawatt are possible, while preserving minimum dimensions as compared with those of conventional machines with the same power.

It is known that the characteristics of a fan are customarily defined by dimensionless coefficients of flow Cd, pressure Cp, and efficiency $\eta$ according to the following equations:

$$Cd = \frac{Q_v}{2L\omega R^2} \quad Cp = \frac{\Delta P}{\rho\omega^2 R^2} \text{ and } = \frac{Q_v \Delta P}{C\omega}$$

in which L is the length of the impeller (m), $\omega$ is the speed of rotation of the impeller (rd/s), R is the radius of the impeller, $\rho$ is the air density (Kg/m$^3$), Qv is the flow rate of the fan (m$^3$/s) and $\Delta P$ is pressure variation (Pa).

BRIEF DESCRIPTION OF THE DRAWINGS

Better understanding of the invention will be gained through reading the description that follows of a design method, relating to illustrations, given solely for information in which:

FIG. 2 represents a schematic illustration of the position of the downstream leading edge of the cross-head element, FIG. 3 is a schematic illustration of the impeller-cross-head plane surface and FIG. 4 that of the hollow impeller-cross-head surface, FIG. 5 represents an illustration of the upstream plane face of the cross-head and FIG. 6 that of the hollow upstream face of the cross-head, FIG. 7 represents a schematic illustration of the position of the scroll leading edge and of the upstream face of the scroll leading edge, FIG. 8 represents the trace of the downstream scroll.

DETAILED DESCRIPTION

Figure 1:
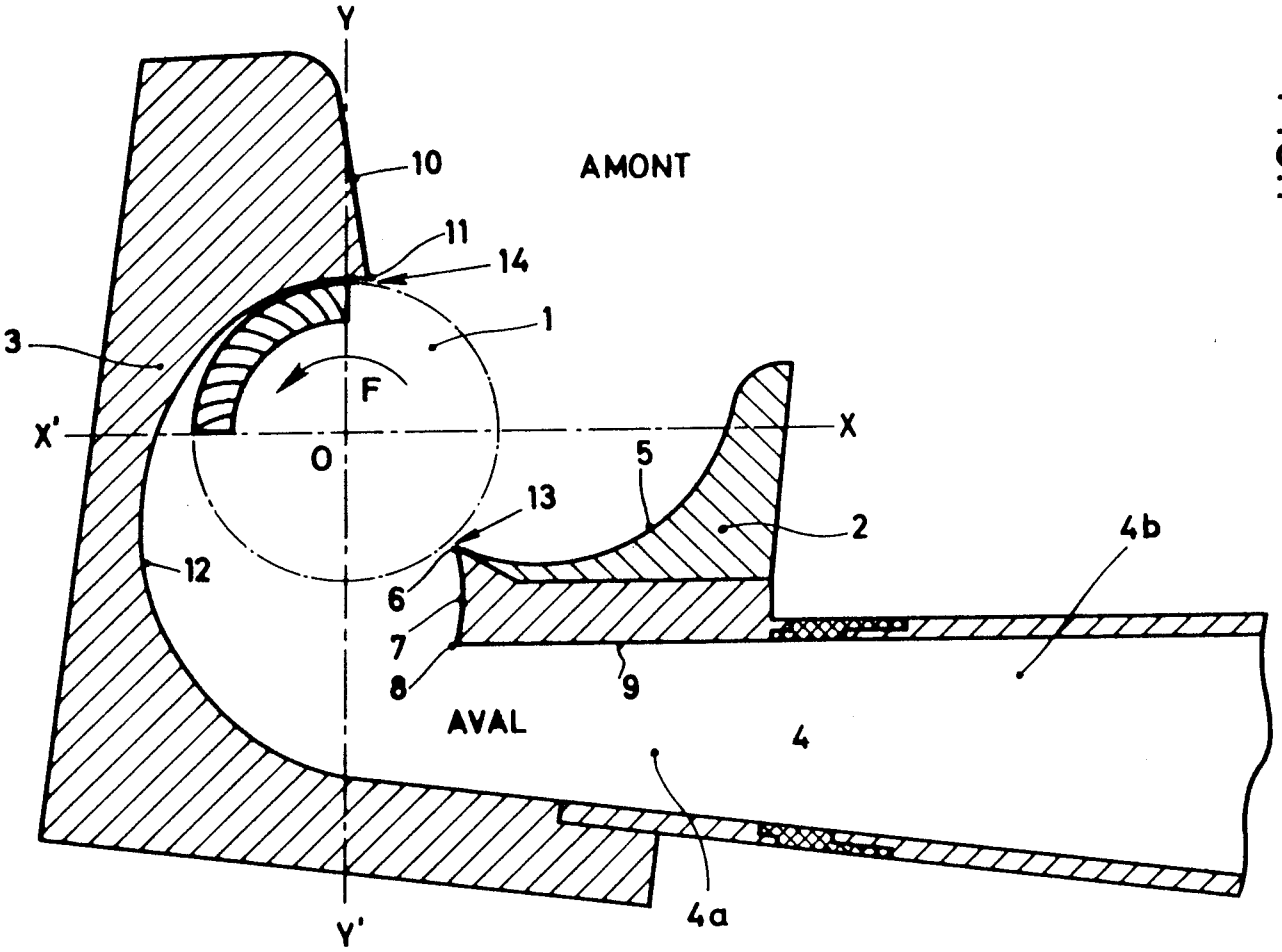
FIG. 1 respresents a general view of the assembly of a transverse fan.

FIG. 1 represents an example of the design of a cross flow fan including an impeller 1, rotating in the direction of arrow F, a cross-head element 2, and a scroll element 3. The scroll and cross-head elements form the stator of the rotating machine, and demarcate an upstream convergent section portion and a downstream divergent section portion, the latter being followed by a load circuit 4*b*, represented in part.

Cross-head element 2 includes an upstream face 5 or upstream scroll, an upstream leading edge 6, an impeller-cross-head face 7, downstream leading edge 8, and downstream face 9.

The scroll element 3 includes an upstream face 10, a scroll leading edge 11 and a downstream scroll 12.

The upstream leading edge 6 of the cross-head is placed at a distance from impeller 1 referred to as air gap 13 of cross-head leading edge (ECR). Leading edge 11 of the scroll is also placed at a distance from impeller 1, referred to as scroll leading edge air gap 14 (EVR).

To define the characteristics of the fan according to the invention, a perpendicular axis reference point OXY is defined whose origin 0 coincides with the axis of impeller 1 and whose abscissa axis is parallel to downstream face 9 of cross-head element. The linear dimensions are expressed conventionally as a percentage of the outside diameter De of impeller 1.

The position of upstream cross-head leading edge 6 is defined, in accordance with FIG. 2, by angle $A_{BCAM}$ between the X axis and radius D of impeller 1 passing through said leading edge. This angle can be included between 290° and 330°. By construction, this angle can be adopted at a fixed value wherefrom the position of the other elements is defined. In FIG. 2 the angle is 309° with a zero air gap.

The dimension of air gap 13 (ECR) is included between 2 and 8% of the outside diameter De of the impeller and more often between 2 and 3%.

FIG. 3 is a diagrammatic representation - for a zero air gap - of cross-head thickness Ec and its inclination $A_{FRC}$ with respect to parallel 15 at axis Y passing through the upstream leading edge 6 of cross-head. Thickness Ec is measured between plane downstream face 9 and plane 16 parallel to this face passing through leading edge 6. Thickness Ec is included between 0.1 and 40% of outside diameter De of impeller 1 and more advantageously, between 14 and 18%.

With thickness Ec defined thus, cross-head-impeller face 7 can either be plane or hollow in order to organize the internal airflow as a function of the application in view. Similarly, cross-head-impeller face 7a, represented in FIG. 3, is plane and set at an angle $A_{FRC}$ with respect to parallel 15 included between −30° and +60° and more particularly between −10° and +10°. Conversely, cross-head-impeller face 7b, represented in FIG. 4 is hollow in the form of a circle arc while upstream leading edge 6 and downstream leading edge 8 of the cross-head, in said configuration, are aligned on parallel 17 at axis Y. The curve center B of this circle arc is located on the median line of chord 18 connecting leading edge 6 and 8 and angle $A_{FRC}$ is determined by tangent 19 passing through leading edge 6 and chord 18. This angle is included between 0° and 60° and more advantageously between 10° and 25°. Note that when angle $A_{FRC}$ is nil, (0), face 7b is plane.

Upstream face 5 of the cross-head can either be plane 5a (FIG. 5) or hollow 5b (FIG. 6). It extends from upstream leading edge 6 of cross-head and a point $M_{FAC}$. Face 5a is defined by its angular position with respect to axis x and by its length projected on that axis. Angle $A_{FAC}$ is included between 25° and 80° and its length (1) when projected, is included between 90 and 100% of the outside diameter De of impeller 1.

Hollow face 5b, represented in FIG. 6, is defined by angle $A_{FAC}$ between the radius of the impeller passing through upstream leading edge 6 of cross-head and the tangent at this point to the form under study. Angle $A_{FAC}$ is included, as previously, between 25° and 80° and more particularly between 60° and 78°. Curve center C is located on a median line at chord 20 passing through leading edge 6 and point $M_{FAC}$. Length (1) of said hollow face, projected onto an axis parallel to axis X is included between 90 and 100% of outside diameter De of impeller 1.

Scroll leading edge 11 whose position is schematized in FIG. 7, is located on a circle arc 21 at a distance or air gap 14 (EVR) included between 2 and 8% of impeller 1 outside diameter De. Circle arc 21 is delimited by angle $A_{BC}$ included between 76° and 112°. In this figure can also be seen upstream face 10 of scroll leading edge inclined at angle $A_{FABV}$ with respect to a radius passing through leading edge 11 of the scroll. Angle $A_{FABV}$ is included between 0° and 70°. The two angles are chosen to ensure the optimum supply compatible with the desired nominal point.

FIG. 8 represents the downstream scroll 12, made up of 3 parts, 21, 22 and 23. Part 21 is an arc, again concentric with impeller 1 existing when angle $A_{BC}$ is less than 112°. The two parts 22 and 23 are defined from cross-head element 2 by demarcating an initial section SHBCAV (horizontal section of downstream cross-head leading edge) parallel to the X axis such that its length is included between 80 and 100% of the outside diameter De of impeller 1 and a second section noted SBCAV (vertical section of downstream cross-head leading edge), such that its length be included between 60 and 90% of outside diameter De of impeller 1. These sections define the two points $M_{MBCAV}$ and $M_{VBCAV}$. The scroll is then made up of part 22, a circle arc passing through point $M_{HBCAV}$ tangent to part 21 and to plane part 23 passing through point $M_{VBCAV}$, forming an angle of 7° with the X axis.

Finally, the scroll is connected to divergent plane 24 by plane section 23 extending said plane. Divergent 4b is demarcated by a plane surface extending downstream face 9 of cross-head and plane section 24, forming an angle of 7° with the X axis. This produces a fan divergent at 7°, a value commonly accepted in fluid mechanics as far as the obtaining of a minimum load loss is concerned.

The impeller of a cross flow fan is defined in a known manner by the following parameters: outside and inside diameters, length, number of blades, blade curve radius, blade chord, blade entry and exit angles, flange diameter. The ranges of variation of these parameters are well known and there is no need to explain them in detail.

Figure 9:
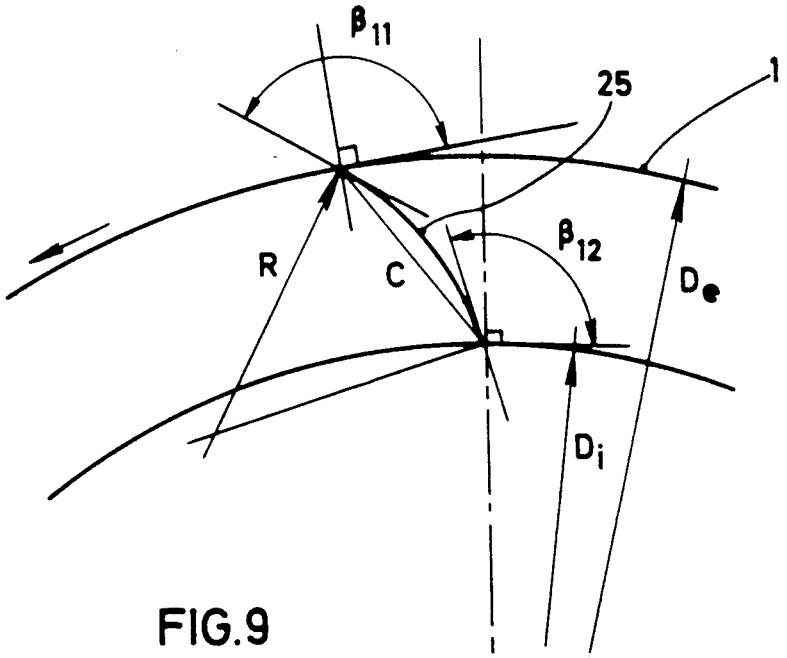
FIG. 9 illustrates the method of designing an impeller blade.

For the sake of simplification, FIG. 9 represents a blade 25 of impeller 1 which is of the forward-curved typed i.e. when $\beta_{11}$ is greater than 90°. Each blade is defined by the following parameters:

the ratio of internal diameter Di and external diameter De of the impeller; customarily this ratio is included between 0.7 and 0.8;

curve radius R; this radius is included between 10 and 15% of the outside diameter De of the impeller.

chord C; the chord is included between 10 and 15% of the outside diameter De of the impeller, aspect ratio; this ration is expressed by the length-/diameter ratio and varies between 1 and 5.

These parameters make it possible to set the blade and define angles $\beta_{11}$ and $\beta_{12}$ which vary respectively in a range of 120° to 170° and 70° to 100°.

Figure 10:
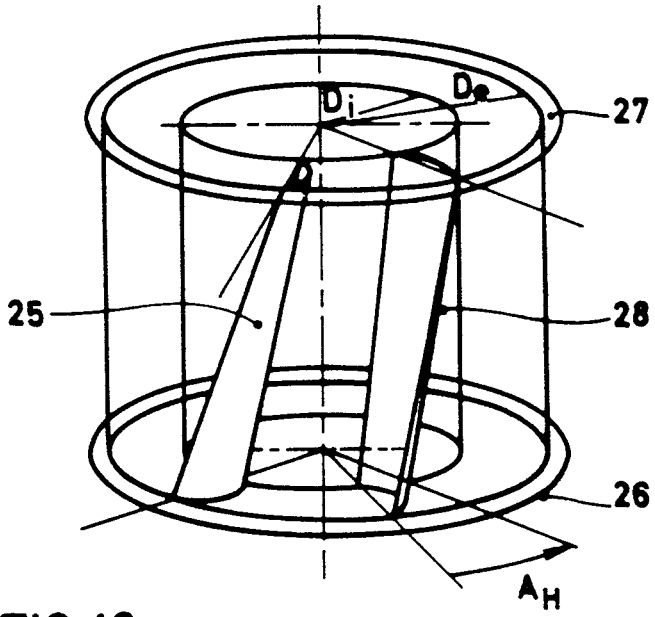
FIG. 10 represents a particular design of the impeller.

Impeller 1 can be twisted as shown in FIG. 10 by the rotation of flanges 26 and 27 with respect to one another through an angle of helix $A_H$. The leading edge 28 of each blade 25 then defines a curve having an angle of helix $A_H$ less than 10°. This design will, among other things, decrease the noise and amplitude of the vibrations. As a variant, the line described by leading edge 11 of the scroll and/or the upstream cross-head leading edge 6 can be twisted according to the same law.

Figure 11:
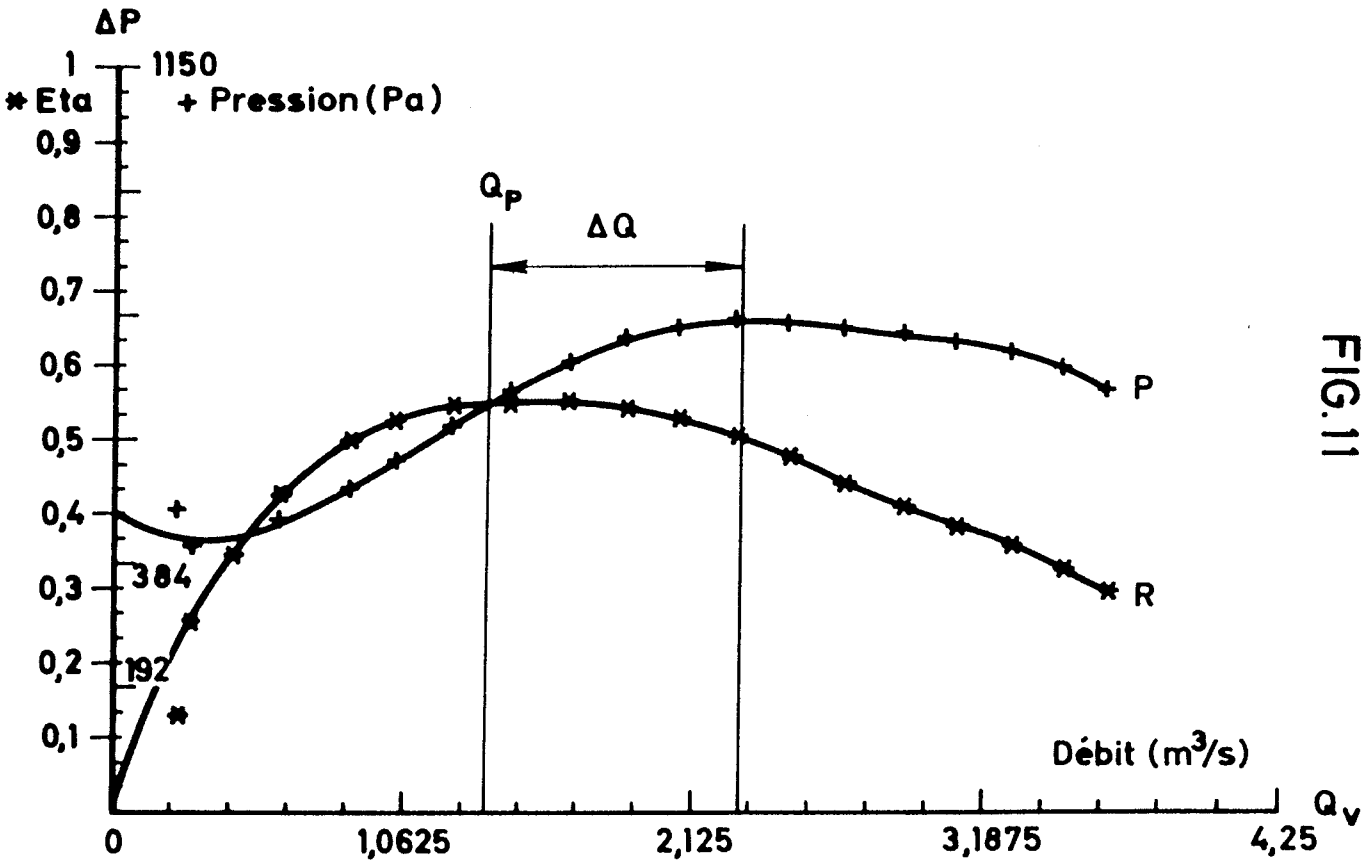
FIG. 11 is an example of the aeraulic curves obtained according to the invention.

FIG. 11 represents the pressure/flow characteristic of a transverse fan with the following geometrical characteristics:

outside diameter De=283 mm
inside diameter $D_i$=223 mm i.e. $D_i/D_e$=78.95%,
number of blades $N_p$=40
Straight cross-head $E_C$=46 mm i.e. $E_C$/De=16.25%
$A_{FRC}$=0°
$A_{FAC}$ with minimum air gap=40°
Curve radius of cross-head upstream scroll=251 mm
$A_{FABV}$ with minimum air gap=40°
$S_{HBCAV}$ with minimum air gap=166 mm i.e. 58.64% of De
$S_{VBCAV}$ with minimum air gap=220 mm i.e. 77.73% of De
Curve radius of downstream scroll=301 mm i.e. 106.47% of De
Scroll/impeller air gap EVR=6 mm i.e. 2.12% of De
Cross-head/impeller air gap ECR=8 mm i.e. 3.03% of De.

The power obtained is approximately 2 KW for a 420 mm long fan whereas to obtain equivalent power by an axial or centrifugal fan it would require a diameter and length of at least 2 to 3 times more. Values ΔP and Qv are measured at the fan outlet. Curve P represents the pressure variation and curve R and efficiency.

Note that strong pressure maxima of approximately 750 Pa are obtained simultaneously for high flow rates of around 2 $m^3/s$ for a maximum usable efficiency of around 60%. In addition, this fan has a increased surge margin ΔQ compared with conventional machines with a humped curve and can be used in a flow excursion range free of surge risks. In this figure it can be seen that this margin ΔQ is on the order of 1 $m^3/s$. This type of fan is therefore suitable for use in the sustentation of hovercraft.

I claim:

1. Cross flow fan comprising an convergent inlet demarcated by upstream face (10) of scroll element (3) and upstream face (5) of cross-head element (2), impeller (1) or rotor provided with blades and divergent (4*a*) demarcated by downstream face (12) of scroll element and downtream face (9) of cross-head element, said inlet and said divergent demarcating with respect to the impeller in a plane perpendicular to its axis of rotation two narrowing longitudinal passages (13,14) defined on the one hand by leading edges (11) of scroll element and on the other hand by upstreamleading edge (6) of cross-head element (2), wherein in a reference system of perpendicular axes X and Y, whose origin is placed at the axis of rotation of impeller (1), and whose abscissas axis X is parallel to downstream face (9) of the cross-head element, it features.

an upstream leading edge (6) of cross-head element describing an angle $A_{BCAM}$ included between 290° and 330° at a distance from impeller or air gap (13) included between 2 and 8% of outside diameter De of the impeller.

a face (7) of cross-head element describing an angle $A_{FRC}$ whose apex is one and the same as upstream leading edge (6) of cross-head included between −20° and 60° with respect to an axis (15) parallel to the ordinates axis concurrent with upstream axis (6), a rectilinear scroll leading edge (11) describing an angle $A_{BV}$ included between 76° and 112° at a distance from impeller or air gap (14) included between 2 and 8% of outside diameter De of the impeller, a plane upstream face (10), concurrent with leading edge (11) of scroll, inclined with respect to the plane connecting the axis of rotation of the impeller and the scroll leading edge (11) by an angle $A_{FABV}$ of a value included between 0° and 70°.

2. Fan according to claim 1, wherein said crosshead element (2) presents between its upstream leading edge (6) and downstream leading edge (8) a thickness included between 1 and 40% of the outside diameter De of the impeller.

3. Fan according to claim 2, wherein the thickness of the cross-head elements (2) is equal to 16.25% of outside diameter De of the impeller.

4. Fan according to claim 3, wherein said cross-head-impeller face (7) is plane and inclined with respect to the Y axis by an angle $A_{FAC}$ included between −20° and 60°.

5. Fan according to claim 3, wherein said cross-head-/impeller face (7) is hollow and in the form of a circle arc (7*b*) passing through upstream (6) and downstream leading edge (8) of cross-head element both placed on a line parallel to axis Y such that tangent (19) to upstream leading edge (6) demarcates an angle $A_{FRC}$ with said parallel to axis Y varying between 0° and 60°.

6. Fan according to claim 5, wherein the length (1) of upstream face (5) of the cross-head, projected onto the X axis is included between 90 and 100% of outside diameter De of the impeller.

7. Fan according to claim 6, wherein said upstream face (5) of the cross-head comprises a plane surface inclined by an angle $A_{FAC}$ included between 10° and 30° with respect to the X axis.

8. Fan according to claim 7, wherein said angle of inclination equals 26° and the length (1) equals 95% of outside diameter De of the impeller.

9. Fan according to claim 6, wherein said upstream face (5) of cross-head comprises a circle arc (5) open toward the impeller whose tangent to upstream leading edge (6) of the cross-head, demarcates with respect to a radius passing through upstream leading edge (6) an angle $A_{FAC}$ included between 20° and 80°.

10. Fan according to claim 1, wherein said downstream scroll (12) extends in a divergent (24) demarcating an angle of 7° with respect to the abscissa axis from a point located on a parallel to the ordinate axis passing through the downstream cross-head leading edge at a distance from said leading edge included between 60 and 90% of outside diameter De of the impeller.

11. Fan according to claim 10, wherein said downstream scroll (12) is demarcated in its section by a first circle arc (21) concentric with impeller (1) and a second circle arc (22) connecting the first circle arc to divergent (24).

12. Fan according to claim 11, wherein said downstream scroll (3) passes through an axis placed on a line parallel to the X axis passing through downstream leading edge (8) of cross-head (2), at a distance from the latter included between 60 and 120% of outside diameter De of the impeller.

13. Fan according to claim 12, wherein said distance equals 59% of the outside diameter of the impeller.

14. Fan according to claim 13, wherein said impeller is of forward-curved blade type with an internal diameter included between 70 and 80% of its outside diameter and in that each blade has, as a function of outside diameter De of the impeller, a curve radius included between 10 and 15%, a chord of between 10 and 15% and an aspect ration included between 1 and 5.

15. Fan according to claim 14, wherein said blades (25) are longitudinally twisted through an angle of helix $A_H$ less than 10°.

16. Fan according to claim 15, wherein said impeller (51) is twisted by the rotation of end flanges (26,27) with respect to one another.

17. Fan according to claim 15, wherein said cross-head leading edge element (2) is twisted through an angle of helix of less than 10°.

* * * * *

UNITED STATES PATENT AND TRADEMARK OFFICE

CERTIFICATE OF CORRECTION

PATENT NO. : 4,836,743

DATED : June 6, 1989

INVENTOR(S) : GUEZOU et al

It is certified that error appears in the above-identified patent and that said Letters Patent is hereby corrected as shown below:

Title page, item [75] inventor "Jean-Pierre Gue ou" should read

--Jean-Pierre Guezou--.

Signed and Sealed this

Twenty-sixth Day of December, 1989

*Attest:*

JEFFREY M. SAMUELS

*Attesting Officer* *Acting Commissioner of Patents and Trademarks*